United States Patent [19]

McLaughlin et al.

[11] Patent Number: 4,864,777

[45] Date of Patent: Sep. 12, 1989

[54] METHOD OF AUTOMATED GRINDING

[75] Inventors: Michael H. McLaughlin, Scotia; Carl M. Penney, Schenectady, both of N.Y.

[73] Assignee: General Electric Company, Schenectady, N.Y.

[21] Appl. No.: 226,508

[22] Filed: Aug. 1, 1988

Related U.S. Application Data

[62] Division of Ser. No. 37,663, Apr. 13, 1987.

[51] Int. Cl.[4] ..... B24B 1/00

[52] U.S. Cl. ..... 51/281 R; 51/165.71; 51/165.72; 51/326; 901/47; 901/41; 364/474.06; 364/513

[58] Field of Search ..... 901/41, 45, 44, 47; 51/165.71, 165.72, 165.77, 165 R, 281 R, 326; 364/474.06, 513

[56] References Cited

U.S. PATENT DOCUMENTS

| | | | |
|---|---|---|---|
| 3,976,382 | 8/1976 | Westby | 901/47 X |
| 4,337,566 | 7/1982 | DiMatteo et al. | 51/326 X |
| 4,491,719 | 1/1985 | Corby, Jr. | 219/124.34 |
| 4,523,409 | 6/1985 | DeFazio | 51/165.71 |
| 4,545,106 | 10/1985 | Juengel | 901/47 X |
| 4,550,532 | 11/1985 | Fletcher et al. | 51/165.72 X |
| 4,568,816 | 2/1986 | Casler | 901/47 X |
| 4,604,715 | 8/1986 | Toutant et al. | 364/513 |
| 4,645,917 | 2/1987 | Penney et al. | 250/201 |
| 4,753,048 | 6/1988 | Asada et al. | 51/281 |
| 4,761,596 | 8/1988 | Nio et al. | 364/513 X |

FOREIGN PATENT DOCUMENTS

| | | | |
|---|---|---|---|
| 0020858 | 2/1985 | Japan | 51/283 R |

OTHER PUBLICATIONS

Bangs, Scholer, "Laser Vision Robot Guides Welding Arc", Welding Design & Fabrication, (1984), 45.

"Autovision ® 4 High Speed Vision System for Inspection or Robot Guidance", Automatix Product Bulletin.

"Adaptivision 3-D Visitech 1000", Adaptive Technologies, Inc.

*Primary Examiner*—Frederick R. Schmidt
*Assistant Examiner*—Shirish Desai
*Attorney, Agent, or Firm*—Donald R. Campbell; James C. Davis, Jr.; Paul R. Webb, II

[57] ABSTRACT

Automated grinding is performed using a tracking means having a sufficient field of view to locate edges to be processed and using a high resolution profiler in order to provide grinding information for calculation of the amount of material which should be removed from the workpiece. Those sections of the workpiece not requiring additional grinding may be traversed at a high speed in order to improve productivity. A process control computer receives grinding information from the tracking means and high resolution profiler and uses it to control a manipulator to adjust the travel speed of the grinder, force with which a grinder is applied, position of the grinder, and/or speed of rotation of the grinder in order to remove the correct amount of material from a workpiece. The technique is especially advantageous in removing excess material, burrs, nicks, chips and other minor irregularities in workpieces. A second profiler may be used to check that the grinder has properly ground portions of the workpiece. The tracking means and the profilers are flying spot laser profilers. The technique can accommodate either force-control or position-control grinding.

4 Claims, 5 Drawing Sheets

METHOD OF AUTOMATED GRINDING

This application is a division, of application Ser. No. 037,663, filed Apr. 13, 1987.

BACKGROUND OF THE INVENTION

This invention relates to an automated grinding system and method. More specifically, this invention relates to automated grinding using the combination of a tracking sensor to locate the edge and a high resolution sensor to locate the regions of that edge which require reshaping by grinding.

Many metal fabrication processes require heavy grinding (e.g., arc-welding) and/or deburring (e.g., milled or turned parts) to reach a final part shape. Much of the work is presently done manually with hand-held grinding tools. The use of force-controlled or path-controlled robots has been proposed for such tasks.

Various robotic grinding and deburring techniques have been used. However, such techniques have often had one or more of several disadvantages. The speed of grinding and deburring operations has been lower than desirable, thereby limiting the productivity of such techniques. Additionally, such techniques have often been unable to satisfactorily detect and remove burrs, nicks, or other small variations from desired shape. Robotic grinding techniques often have maintained a grinder upon a preprogrammed path and, therefore, provide for little flexibility in adapting the grinding operation to the particular workpiece based upon the characteristics of the workpiece.

OBJECTS OF THE INVENTION

Accordingly, it is a primary object of the present invention to provide a new and improved automated grinding system and method.

A more specific object of the present invention is to provide a fast and productive automated grinding technique.

Another object of the present invention is to provide automated grinding which is highly efficient at detecting and removing burrs, nicks, or other small variations from desired part shape.

Yet another object of the present invention is to provide automated grinding which is highly flexible in allowing a grinder to be readily adapted for grinding upon a particular workpiece.

SUMMARY OF THE INVENTION

The above and other objects of the present invention which will be apparent as the description proceeds can be realized by an automated grinding system comprising: a multiaxis manipulator, a grinder mounted on the manipulator for grinding upon a workpiece; tracking means, such as a low resolution optical profiler having a suficient field of view to locate edges to be processed for passage over the workpiece in advance of the grinder; a high resolution profiler mounted to the manipulator for passage over the workpiece in advance of the grinder, the high resolution profiler having a vertical and horizontal resolution adapted to detect excess material, burrs and nicks. This invention includes also a process control computer operable to receive grinding information from the tracking means and high resolution profiler to determine the location of burrs and nicks and to control the manipulator such that the grinder follows an optimum path and speed to grind the workpiece to a final shape. The process control computer is operable to use grinding information from the tracking means to maintain the grinder on a proper path and operable to use grinding information from the high resolution profiler to determine the amount of material which the grinder should remove. (As used herein, a "profiler" is any industrial sensing system for determining the topography of a workpiece along a line; i.e., generating data on the profile of a surface). The tracking means and high resolution profiler are both mounted to the manipulator. The grinder is retractably mounted to the manipulator. The system further comprises a transversing stage and the grinder is mounted to the arm by way of the transversing stage. The process control computer is operable to cause the grinder to travel along the workpiece at varying speeds depending upon the amount of material which should be removed. The process control computer is operable to cause variation of the power of the grinder depending upon the amount of material which should be removed.

The method of the present invention may be described as a method of automated grinding comprising the steps of: generating grinding information from a tracking means mounted on a manipulator as it is moved along a workpiece; generating grinding information from a high resolution profiler mounted on the manipulator as the high resolution profiler is moved along the workpiece; transmitting grinding information from the tracking means and the high resolution profiler to a process control computer; grinding the workpiece by moving a grinder, which is mounted on the manipulator, along the workpiece, the grinder being moved to follow the high resolution profiler; and controlling the grinding by the process control computer acting upon the manipulator with grinding information from the tracking means being used to maintain the grinder upon a proper path and grinding information from the high resolution profiler being used to determine the amount of material which should be removed by the grinder. The computer controls the amount of material removed by the grinder based upon grinding information from the high resolution profiler by one or more substeps of the group comprising: varying the travel speed of the grinder; adjusting a transversing stage to which the grinder is mounted; varying a rotation speed of the grinder; and causing the grinder to vary its number of passes over different portions of the workpiece. The tracking and high resolution profiler are both mounted on the manipulator such that the process control computer controls movement of the tracking means and high resolution profiler by controlling movement of the manipulator. The process control computer controls the amount of material removed by the grinder by varying the grind power of the grinder.

BRIEF DESCRIPTION OF THE DRAWINGS

The above and other features of the present invention will be more apparent as the following detailed description is considered in conjunction with the accompanying drawings wherein like characters represent like parts throughout the several views and in which.

DETAILED DESCRIPTION

Figure 1A:
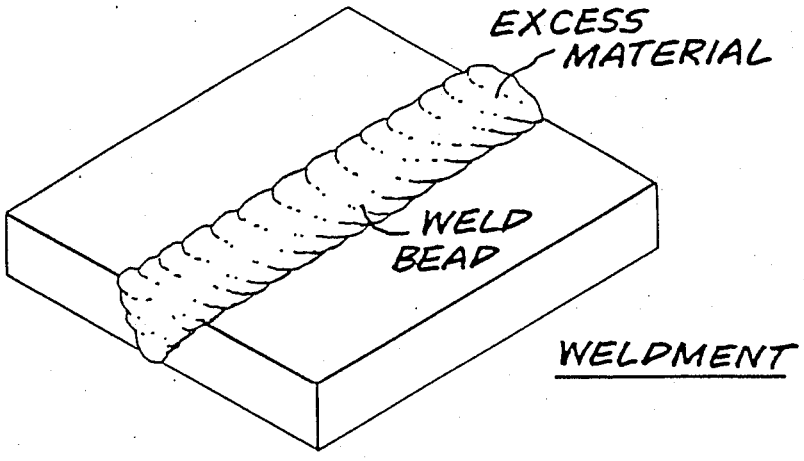
FIG. 1A shows a perspective view of a weldment.
Figure 1B:
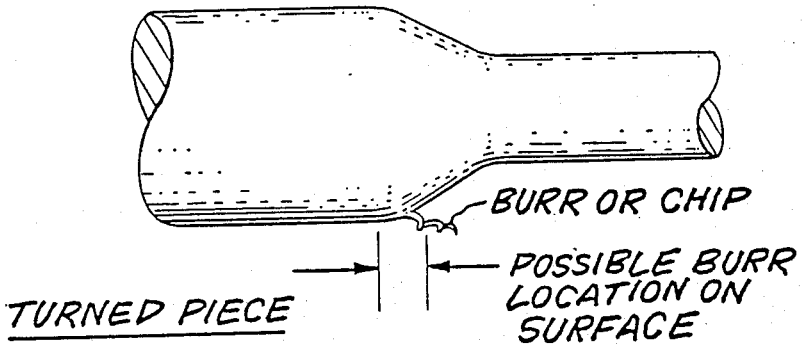
FIG. 1B shows a side view of a turned piece.
Figure 1C:
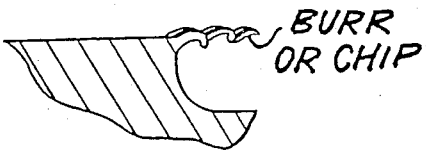
FIG. 1C shows a cross-section view of a corner with a burr.
Figure 1D:
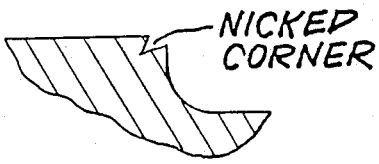
FIG. 1D shows a cross-section of a corner with a nick.

The present invention may be used upon various types of workpieces requiring heavy grinding and/or deburring such as weldments having weld beads with excess material as illustrated in FIG. 1A. The grinding system and methods of the present invention allows one to track the weld bead and remove excess material as required in order to change the shape of the weldment to conform with a predetermined final part shape. In similar fashion, the techniques of the present invention described below are well adapted to detection and removal of a burr or chip upon a turned piece (FIG. 1B). As shown in FIG. 1B, the burr, chip, or other irregularity may be expected to fall within a circumferential band designated by the possible burr location label. One may use the present invention for advantageously searching for burrs, nicks, or other irregularities within a prescribed zone of a workpiece such as along a weld-bead illustrated in FIG. 1A, a possible burr location zone illustrated in FIG. 1B, a corner having a burr or chip illustrated in FIG. 1C, or a corner having a nick as illustrated in FIG. 1D.

Figure 2:
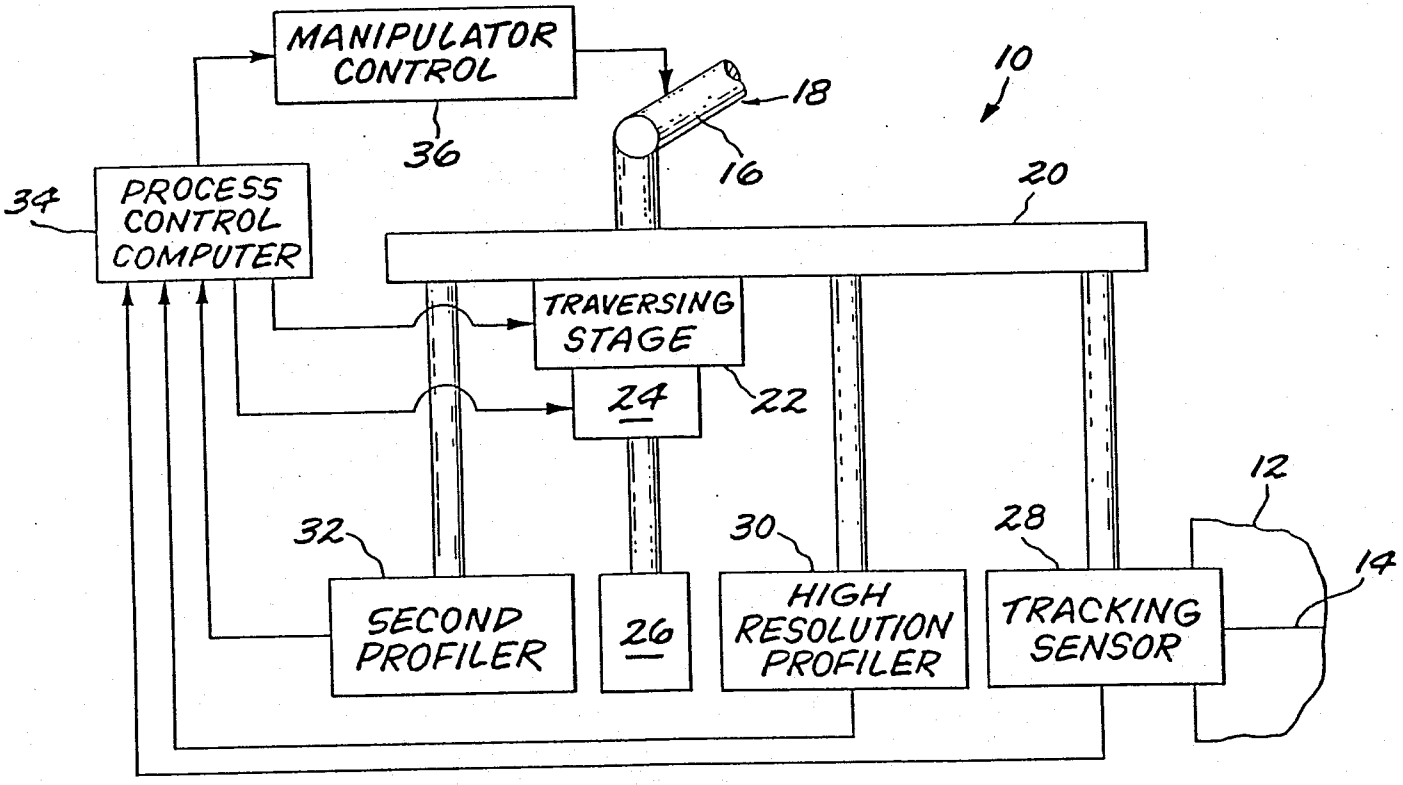
FIG. 2 shows a schematic representation of the system of the present invention.

The automated grinding system 10 of the present invention is illustrated in FIG. 2 and may be used for dealing with the type of irregularities shown in FIGS. 1A to 1D. The system 10, which may be used for shaping workpiece 12 having a corner or edge 14, includes an arm 16 which is part of a manipulator 18. The manipulator 18 and arm 16 are not completely shown, it being readily understood that any of various known types of manipulators, such as a robot, could be used. Mounted to the arm 16 is a support piece 20, a transversing stage 22, grinder speed control 24, and grinder or grind wheel 26. The grinder speed control 24 includes a motor (not separately illustrated) which causes rotation of the grinder 26 to grind upon the workpiece 12.

Tracking sensor 28, a high resolution profiler 30, and an optional second profiler 32 are mounted upon the arm 16 by way of the support 20. Each of the devices 28, 30, and 32 may be a flying spot laser profiler of the type described in U.S. Pat. No. 4,645,917, Thomas, Roy and Penney entitled "SWEPT APERTURE FLYING SPOT PROFILER", assigned to the assignee of the present invention. That patent is hereby incorporated by reference.

The first profiler 28 is a tracking profiler which provides a sufficient field of view to locate edges to be processed. The high resolution profiler 30 serves to locate burrs or nicks for removal. Determination of burr or nick location and shape will typically require high resolution profilers 30 with vertical and horizontal resolution approaching 0.1 mil. We note that it is inconvenient to make such a profiler with a field of view larger than about 20 mils; therefore a separate edge location device with a larger field of view is required for optimum grinding.

The second profiler 32, which is optional, is used for checking to determine if the grinder 26 has properly ground the workpiece 12. The second profiler 32 would preferably have optical characteristics including vertical resolution, stripe characteristics, and depth of field characteristics like those of high resolution profiler 30. Unlike the tracking sensor 28 and high resolution profiler 30 which move in front of the grinder, the second profiler 32 trails the grinder 26 as it moves along the workpiece 12.

Each of the devices 28, 30, and 32 supplies grinding information to a process control computer 34. The process control computer 34 uses multiaxis information from the devices 28, 30, and 32 to control a manipulator control 36 as well as the transversing stage 22 and the grinder speed control 24. The manipulator control 36 controls the manipulator 18 by various well known mechanisms which need not be described in detail. The process control computer 34 controls the position of the grindwheel 26 by moving the manipulator arm 16 and acting upon the transversing stage 22. Together with its control of the grinder speed control 24, this allows the process control computer 34 to control the grinding of the grindwheel 26 upon the workpiece 12 to properly shape the workpiece 12.

Figure 3A:
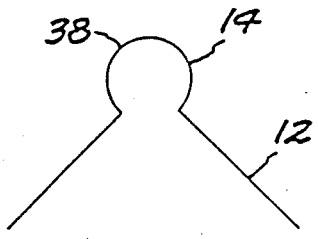
FIG. 3A shows the image of a corner with a burr as seen by a tracking sensor of the present invention.
Figure 3B:
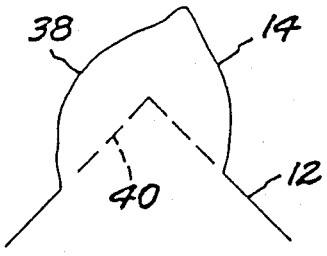
FIG. 3B shows an image of the same corner as seen by a removal profiler according to the present invention.

As an example of the type of operation which the system 10 performs upon a workpiece 12, reference is made to FIGS. 3A to 3D. Each of these figures represents the view or image "seen" by the process control computer 34 from one of the devices 28, 30 or 32. FIG. 3A shows the workpiece 12 having an edge 14 with a burr 38 on it. The view of FIG. 3A is that seen by the tracking sensor 28 which has a relatively large field of view. Although this relatively large field of view allows the sensor 28 to track the edge 14 of the workpiece 12, the vertical resolution is insufficient to provide a detailed view of the burr 38. In contrast, the image of FIG. 3B is that seen by the high resolution profiler 30 and shows the burr 38 with great clarity. Because the high resolution profiler 30 must have sufficient vertical resolution to clearly provide an image of the burr 38, its field of view is relatively small and would make it inadequate to allow proper tracking of the corner 14. FIG. 3B shows phantom lines 40 illustrating the ideal shape for the edge 14. All of the material above the ideal shape lines 40 is excess material which should be removed by the grinder 26. The high resolution profiler 30 provides the necessary resolution such that the process control computer 34 may operate the grinder 26 to remove the excess material. Accordingly, the high resolution profiler 30 may be considered as a "removal" profiler in that it provides information as to the amount of material which should be removed from the workpiece 12.

Figure 3C:
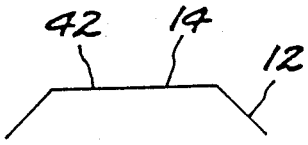
FIG. 3C shows an image of the corner as seen by a second profiler after grinding by a single pass.
Figure 3D:
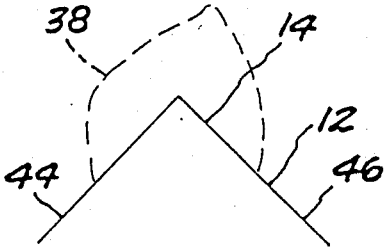
FIG. 3D shows the image from the checking profiler after grinding with two passes.

FIG. 3C shows an image of the workpiece 12 as seen by the third profiler 32 after the grinder 26 has removed the excess material and shaped the corner 14 by grinding a flat portion 42. This flat portion 42 could be obtained by having the grind wheel 26 grind during a single pass along the corner or edge 14. The optional third profiler 32, upon seeing the view of FIG. 3C, would indicate to the process control computer 34 that the grindwheel 26 has properly removed the burr 38.

As an alternative to the single pass approach illustrated in FIG. 3C, the process control computer 34 could alternately remove the burr 38 (shown in phantom line in FIG. 3D) by making two passes such that the corner 14 more closely resembles the ideal lines 40 in FIG. 3B. The grinding of the burr 38 down to obtain the edge 14 of FIG. 3D may be accomplished by orienting the grinder 26 to grind in a plane parallel to surface 44 of the workpiece 12 and then, making a second pass over the corner 14 grinding in a plane parallel to surface 46 of workpiece 12. Although the two pass approach of FIG. 3D requires more time than the single pass approach of FIG. 3C, it may be advantageous in situations where the edge or corner 14 must have a more regular shape than that produced by the process of FIG. 3C.

Figure 4A:
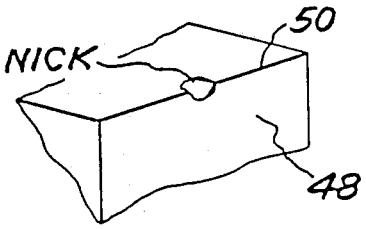
FIG. 4A shows a perspective view of a workpiece having a corner with a nick.
Figure 4B:
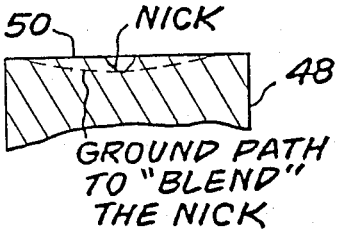
FIG. 4B shows a cross-section view of the workpiece of FIG. 4A.

FIG. 4A shows a workpiece 48 having a corner or edge 50 with a nick illustrated therein, whereas FIG. 4B shows a cross-section view of workpiece 48 taken in a plane intermediate the planes which form corner 50. As illustrated in FIG. 4B, the nick may be repaired by having the grinder 26 follow the grinding or ground path illustrated. In this manner, a nick may be blended into the edge or corner 50. Provided that the nick is sufficiently small to allow such a repairing operation, this allows one to use a workpiece 48 which might otherwise have to be discarded.

Figure 5:
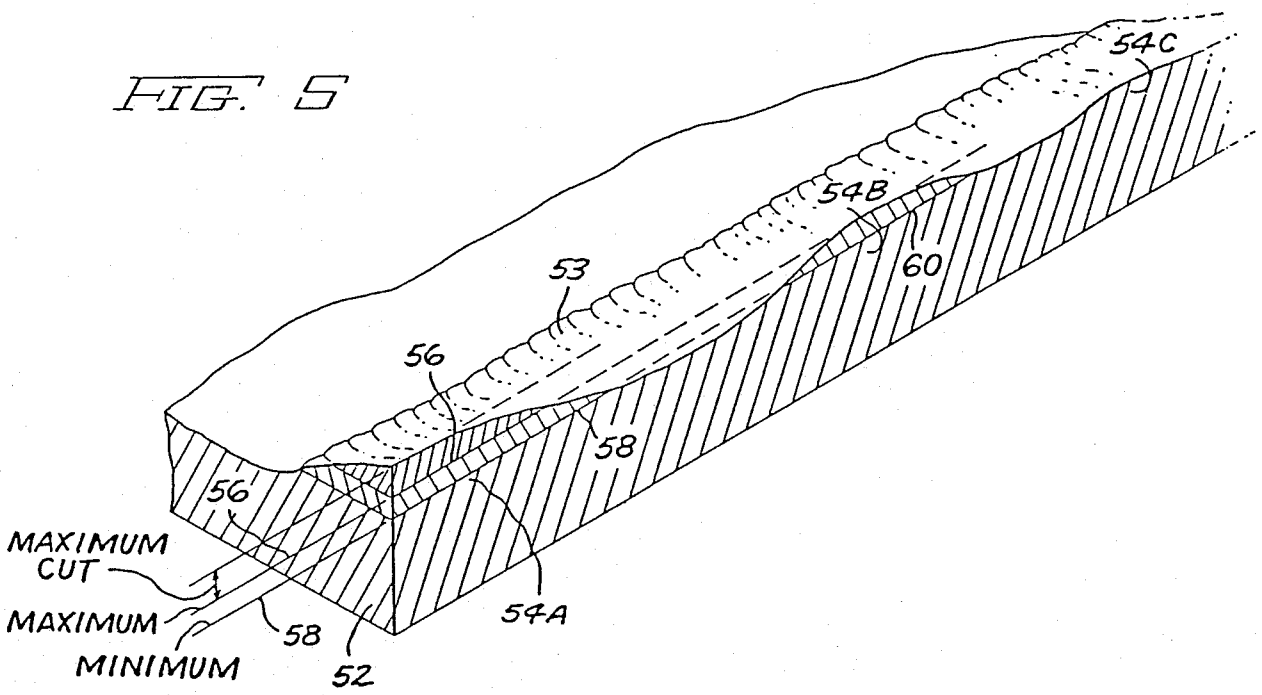
FIG. 5 shows a weld bead and illustrates how the grinding sequence of the present invention would act upon the weld bead.

FIG. 5 shows an isometric view of a workpiece 52 extending from front to back in the view of FIG. 5. Workpiece 52 includes portions 54A, 54B, and 54C which have excess material. The grinding system 10 of FIG. 2 may be used to remove excess material from the workpiece 52 such that any remaining excess material falls between the minimum and maximum final limits illustrated at the left of FIG. 5. The view of FIG. 5 may be used to illustrate a grinding sequence accomplished by the system 10 of FIG. 2. The tracking sensor 28 provides grinding information to the process control computer 34 such that the grinder 26 may be maintained in a proper path. The high resolution profiler 30 provides sufficiently detailed grinding information to allow the computer 34 to calculate the amount of material which should be removed by the grinder 26. The depth of grinding which must be provided to the portion 54A is greater than the maximum depth of grinding. Accordingly, the process control computer 34 will set the grinder 26 to a maximum grinding depth so as to grind the excess material above line 56 off of the portion 54A as the grinder (not shown in FIG. 5) travels from front to back. The process control computer 34 may adjust the depth of grinding by varying the travel speed of the grinder 26 (by changing the rate of movement of robot arm 16) or by changing the grind power of the grinder 26. The grind power may be changed by varying the force with which the grinder is applied to the workpiece and/or varying the rotation speed of the grinder by way of grinder speed control 24. As the grinder moves past the portion 54A and before it reaches the portion 54B, the process control computer 34 will insure that the grinder 26 does not grind any material by retracting the grinder away from the surface. When the grinder reaches the portion 54B, the material above line 60 should be ground off in order to fall within the maximum and minimum boundaries illustrated at the left. Accordingly, and because the amount of material removal which is required is less than the maximum depth of grinding, the process control computer 34 will set the travel speed of the grinder (rate of movement of the arm 16), force with which the grinder 26 is applied against portion 54B, and speed of the grinder so as to grind the portion 54B to the specified height indicated by line 60. The force could be indirectly set by simply having the computer move the grindwheel 26 along line 60. As the grinder moves from portion 54B to portion 54C, it makes a high speed traverse and again performs no grinding. As the portion 54C is within the minimum and maximum limits, the grinder continues the high speed traverse over portion 54C and does not grind that portion.

Recalling that the portion 54A required more than one grinder pass, the process control computer 34 will cause the grinder 26 to repeat a second pass over portion 54A and grind that portion to the specified height by line 58. The second pass over portion 54A to remove the material between lines 56 and 58 may be accomplished in a left to right direction, the same direction as original pass was made. Alternately, the process control computer 34 may store the amount of material removal necessary for the portion 54A such that the grinder 26 may grind the portions between lines 56 and 58 as it traverses portion 54A.

OPERATION

With reference now to the simplified flow chart of FIG. 6 in conjunction with the system schematic of FIG. 2, the operation of the present invention will be described. Upon the start of the grinding operation as indicated by start block 62, the process control computer 34 will check to determine if the grinder is on the proper path in block 64 by comparing information from the tracking sensor 28 (block 66) with a preprogrammed path for the grinder. If the grinder is not on the proper grind path, a change path block 68 will adjust the path of the grinder 26 such that it is proper. Upon the grinder being on the proper path, motion along the path will be maintained by block 70.

Block 70 leads to block 72 which checks to determine if the grinder is properly set to remove the correct amount of material. Block 72 uses profile information supplied from the second profiler at block 74. However, the information from block 74 may first be fed to a nick detection block 76 which, upon detection of a nick, leads to block 78. Block 78 changes the path and/or removal amount in order to blend a nick in the fashion illustrated by FIG. 4B discussed above. If the block 72 tests determine that the grinder is not properly set to remove the correct amount of material, the block 80 tests to determine if the amount of material which should be removed is greater than the maximum grinding depth. If the depth of material which should be ground is less than the maximum amount, the block 80 leads to block 82 which will adjust the grinding parameters to obtain the proper amount of material removal. These parameters may include the travel speed of the grinder, the force with which the grinder is applied against the workpiece, the position of the grinder relative to the surface (i.e., moving the grinder toward or away from the workpiece), and the rotation speed of the grinder. If the amount of material removal necessary exceeds the maximum cutting or grinding depth of the grinder, block 84 sets the grinder for maximum removal and sets a repeat pass indication. Additionally, the block 84 leads to block 86 which would cause grinding at the maximum removal setting, this situation being illustrated by the material removal above line 56 in FIG. 5. In the situation corresponding to portion 54B of FIG. 5, the grinder would be set to remove the proper amount of material (by block 82) and block 72 would lead to block 86 such that the proper amount of material above line 60 would be removed. From block 86, the process control computer leads to block 88 which checks to determine if the grinder is at the end of its path, either preprogrammed path or modified path calculated by the computer 34. If the computer is not at the end of the path, block 88 returns to block 64. Alternately, if the computer indicates that the grinder is at the end of its path, block 90 checks to see if the repeat pass has been set. If the repeat pass has been set, block 90 leads to block 92 which calculates the path of the repeat pass and returns to block 64. If the repeat pass has not been set, block 90 leads to the stop at block 94.

Figure 6:
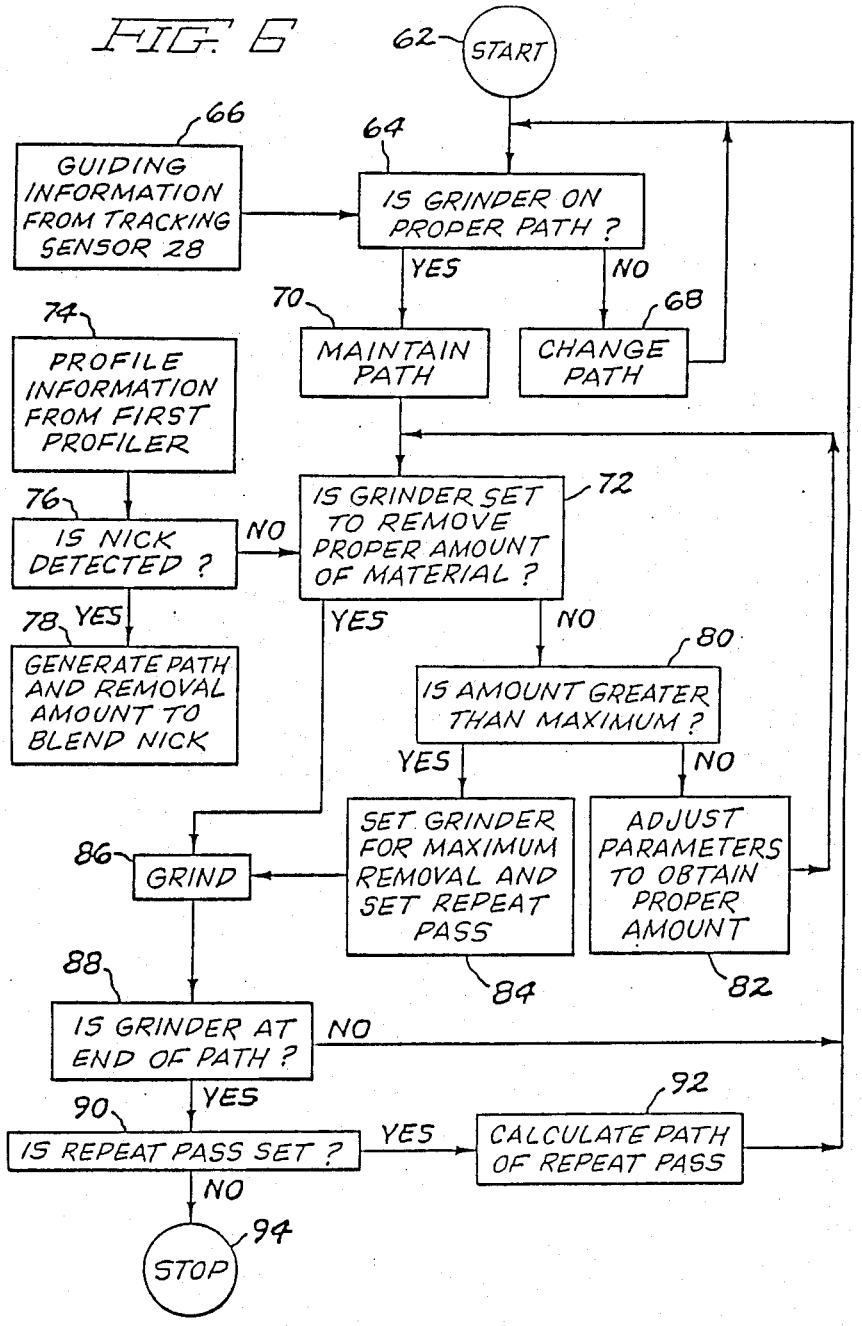
FIG. 6 shows a simplified flow chart of a control arrangement according to the present invention.

Although the profile information from the second profiler 32 is not used in the flow chart illustrated in FIG. 6, profiles from the optional second profiler 32 could be used in a number of different manners. For example, the second profiler 32 could provide a real time check that the grinder is operating properly and, if not, cause the grinder to repeat a pass and/or provide an output indicating that the grinding operation is not working satisfactorily.

Referring back to FIG. 2, the tracking sensor and the high resolution profiler should be configured to view a portion of the workpiece just in advance of a workpiece. Therefore, the tracking sensor, the high resolution profiler and the second profiler may require some degree of freedom for motion relative to the arm 16 if the arrangement is to be used for more complex paths (such as irregular curves) than the relative simple paths illustrated and discussed above.

Although various specific arrangements and constructions have been illustrated and discussed herein, it is to be understood that these are for illustrative purposes only. Various modifications and adaptations will be readily apparent to those of skill in the art. Accordingly, the scope of the present invention should be determined by reference to the claims appended hereto.

What is claimed is:

1. A method of automated robotic grinding comprising the steps of:

generating grinding information from tracking means mounted on a manipulator as the tracking means are moved along a workpiece;

generating grinding information from a high resolution profiler mounted on the manipulator as the high resolution profiler is moved along the workpiece, the high resolution profiler having a higher vertical resolution than said tracking means;

transmitting grinding information from the tracking means and the high resolution profiler to a process control computer;

grinding the workpiece by moving a grinder, which is mounted on the manipulator, along the workpiece, the grinder being moved to follow the high resolution profiler; and controlling the grinding by the process control computer acting upon the manipulator with grinding information from said tracking means being used to maintain the grinder upon a proper path and grinding information from said high resolution profiler being used to determine the amount of material which should be removed by the grinder.

2. The method of claim 1 wherein the process control computer controls the amount of material removed by the grinder based upon grinding information from the high resolution profiler by one or more substeps of the group comprising:

varying the travel speed of the grinder;

adjusting a transversing stage to which the grinder is mounted;

varying a rotation speed of the grinder; and causing the grinder to vary its number of passes over different portions of the workpiece.

3. The method of claim 1 wherein the process control computer controls the amount of material removed by the grinder based upon grinding information from the high resolution profiler by varying the force on, or position, power or speed of the grinder or any combination thereof.

4. The method of claim 1 wherein the process control computer controls the amount of material removed by the grinder based upon grinding information from the high resolution profiler by varying the grinding power of the grinder.

* * * * *